US005189759A

United States Patent [19]

Poore

[11] Patent Number: 5,189,759

[45] Date of Patent: Mar. 2, 1993

[54] SHOWER CURTAIN ROD UNIT

[76] Inventor: Frank A. Poore, 23 Sand Land Dr., Attica, Mich. 48412

[21] Appl. No.: 779,893

[22] Filed: Oct. 21, 1991

[51] Int. Cl.[5] ..... A47H 13/00; A47H 15/00; A47K 3/22

[52] U.S. Cl. ..... 16/87.40 R; 16/94; 4/608; 4/558

[58] Field of Search ..... 16/87.4 R, 94 D; 4/610, 4/608, 609, 558

[56] References Cited

U.S. PATENT DOCUMENTS

| | | | |
|---|---|---|---|
| 2,923,013 | 2/1960 | Wasserman | 4/610 |
| 4,461,056 | 7/1984 | Solinski | 16/87.4 R |
| 4,754,504 | 7/1988 | Cellini | 16/94 D |

*Primary Examiner*—Robert L. Spruill
*Assistant Examiner*—Carmine Cuda

[57] ABSTRACT

A dual curtain rod unit for installation between opposite walls of a shower stall, the unit having an outer rod, a substantially bow-shaped inner rod of uninterrupted, substantially smooth outer surface construction over its entire functional length, a keying shaft on each end portion of the inner rod, a pair of end plates adapted for attachment to opposite walls of a shower stall, a first socket in a forward portion of each of the end plates for receiving and supporting the ends of the outer rod, and a keying socket in a rearward portion of each of the end plates for receiving and supporting the keying shafts of the inner rod in a mating, sliding fit, non-rotative manner with the bow of the inner rod facing toward the outer rod, the keying sockets being the only points of attachment of the inner rod, thus allowing for the uninterrupted surface thereof along its entire functional length for permitting slide hangers mounted thereon to slide without significant resistance.

7 Claims, 2 Drawing Sheets

SHOWER CURTAIN ROD UNIT

This invention concerns shower curtain rod construction and in particular, a novel curtain rod unit having an inner or functional rod for supporting a water barrier curtain, and an outer or decorative rod for supporting a decorative or facade curtain, wherein the two rods and their supporting structure provides markedly improved structural and operational simplicity, strength, and ease of installation.

Heretofore, the concept of dual curtains, one being fuctional and the other being decorative, has led to a variety of rod constructions and arrangements such as shown, for example, in U.S. Pat. Nos.: 4,461,056; 4,361,915; and 4,381,578. Among the problems associated with the arrangements of the latter two of these patents is that as with conventional shower stall-rod assemblies, there is no real effective provision for preventing the escape of water along the top surfaces of the tub ends onto the floor. Regarding the first of these patents, its structure appears to provide improved water retention, however, the inner or functional rod thereof requires excessively complex construction for allowing the curtain to be pulled, and also complex and costly construction for mounting both the inner and outer rods.

Objects therefore, of the present invention are:

To provide a simple, effective and sturdy dual curtain rod unit for shower stalls, wherein the unit has the capability of essentially eliminating water flow or drip out of the tub area, thus minimizing the potential for floor damage such as warping or rotting;

to provide such unit with an adjustment feature for accommodating shower stalls of varying widths;

to provide such unit wherein readily available materials of construction can be employed; and to provide such unit which is easily assembled and mounted in a shower stall by relatively unskilled labor.

These and other objects hereinafter appearing have been attained in accordance with the present invention through the discoveries embodied in the broad statement of the invention as follows:

A dual curtain rod unit for installation between opposite walls of a shower stall, said unit comprising an outer rod, a substantially bow-shaped inner rod of uninterrupted, substantially smooth outer surface construction over its entire functional lengths, keying shaft means on each end portion of said inner rod, a pair of end plate means adapted for attachment to opposite walls of a shower stall, first socket means in a forward portion of each of said end plate means for receiving and supporting the ends of said outer rod, and keying socket means in a rearward portion of each of said end plate means for receiving and supporting the keying shaft means of said inner rod in a mating, sliding fit, non-rotative manner with the bow of said inner rod facing toward said outer rod, said keying socket means being the only points of attachment of said inner rod thus allowing for said uninterrupted surface thereof along its entire functional length for permitting slide hangers mounted thereon to slide without significant resistance.

More preferred embodiments of the invention are as follows:

said keying socket means and said keying shaft means have substantially rectangular or square cross-sectional configurations of close slide-fitting and mating dimensions;

the depth of each said socket means is greater than about one inch to provide length adjustment for said rods during installation and for accommodating shower stalls of different dimensions;

each said end plate means comprises an elongated member having said socket means located substantially adjacent opposite ends thereof;

each of said end plate means comprises a formed metal, plastic or ceramic shell with said socket means comprising apertures formed in an outer wall thereof;

each of said end plate means comprise a substantially solid body of metal, plastic or ceramic with said socket means formed therein;

the depth of each said shell and the overall lengths of said inner and outer rods are dimensioned to provide a significant degree of length adjustment for accommodating shower stalls of different widths; and the outer and inner rods are tubular, the outer rod being substantially straight, and each rod comprises at least two segments wherein a portion of one segment is slidable within a portion of the other segment to provide length adjustment.

The above defined inventions and discoveries will be further understood from the following description and drawings wherein.

Figure 1:
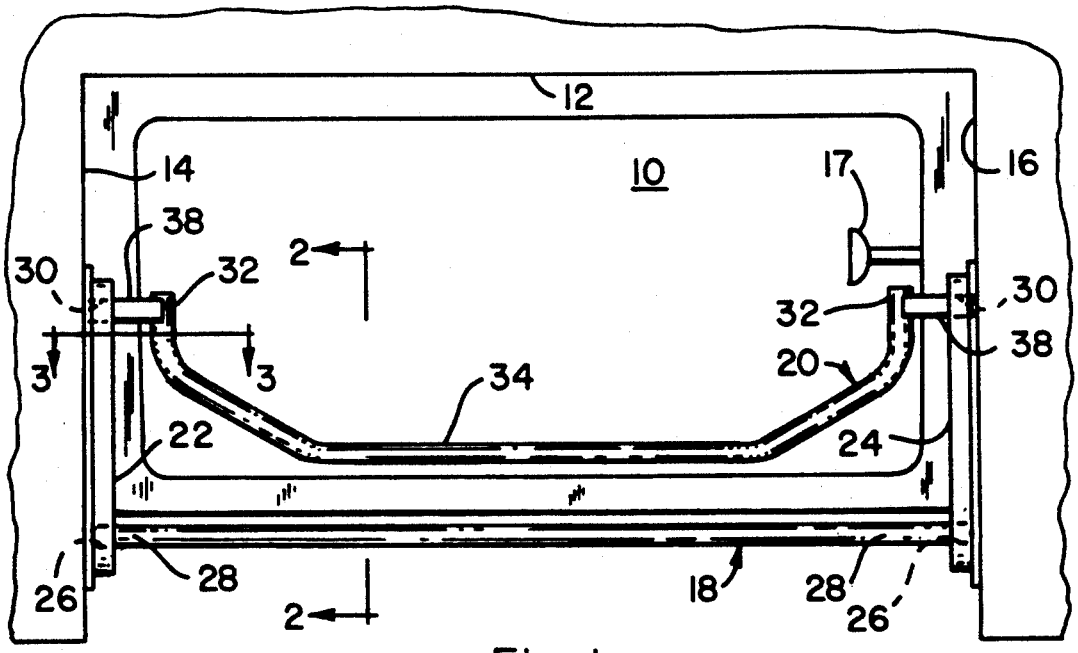
FIG. 1 is a top elevational view of the present shower curtain rod unit mounted over a bath tub between opposite walls of a shower stall.
Figure 2:
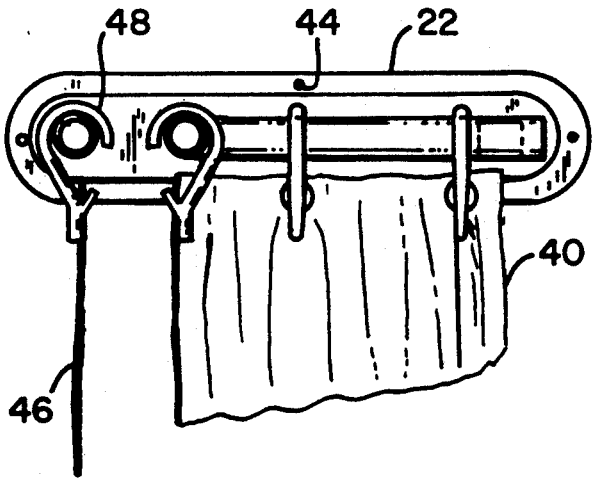
FIG. 2 is a view taken along line 2—2 of FIG. 1 in the direction of the arrows showing portions of the curtains and their hangers depending from the rods, and the end plate in elevation.
Figure 3:
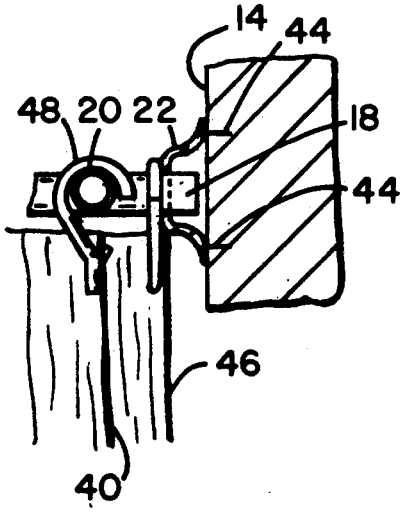
FIG. 3 is a view taken along line 3—3 of FIG. 1 in the direction of the arrows showing portions of the curtains and their hangers in elevation, and the end plate in cross-section.
Figure 5:
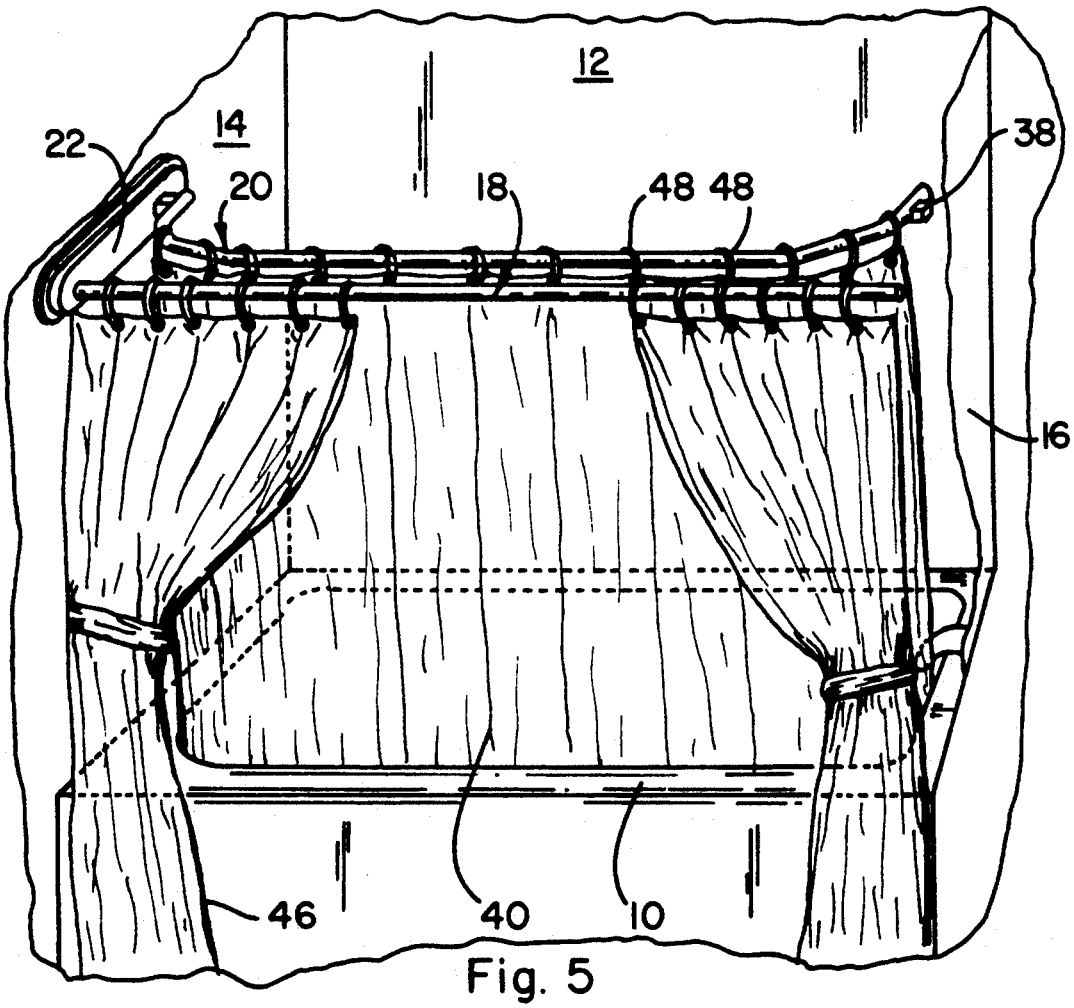
FIG. 5 is an isometric view of the rod unit and curtains mounted in a typical shower stall.
Figure 4:
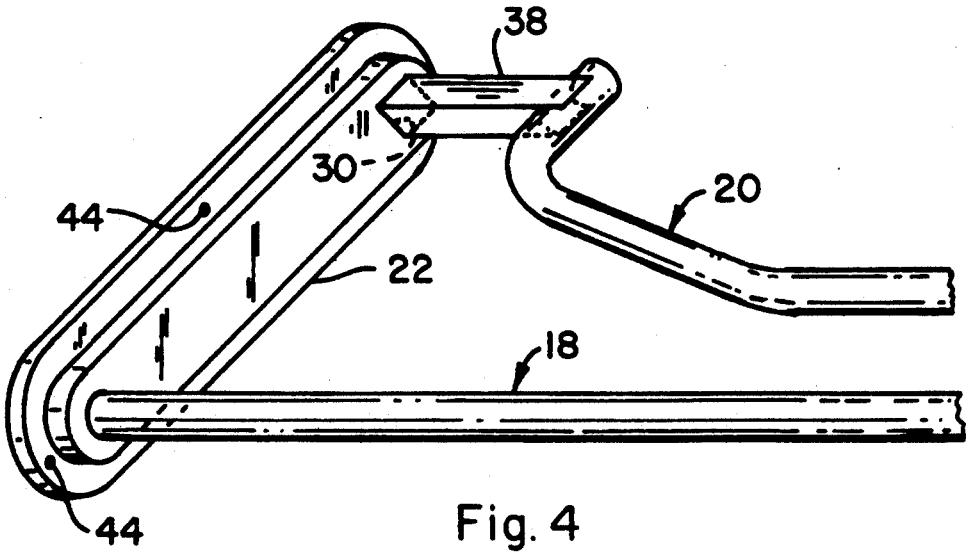
FIG. 4 is an isometric view of a portion of the rod unit viewed from the upper left-front of FIG. 1.

Referring to the drawings wherein indentically constructed or equivalent parts are numbered the same, the present rod unit is designed to be used in any shower area whether a bath tub is present or not, and wherein the area is of any configuration. In the present drawings, a bath tub 10 is shown surrounded on three sides in conventional manner by a shower stall comprising tiled or otherwise water-proofed rear wall 12, and opposing end wall 14 and 16, wherein the shower head 17 and faucets and the like are typically mounted.

The present dual shower curtain rod unit comprises a substantially straight outer rod 18, a substantially bow-shaped inner rod 20, a pair of end plates 22 and 24, adapted for attachment to the opposite ends 14 and 16 of the shower stall, first socket means 26 on a forward portion of each of the end plates for contacting and supporting the ends 28 of the outer rod, and keying socket means generally designated 30 on a rearward portion of each of the end plates for contacting and supporting the end portions 32 of the inner rod with the bow generally designated 34 facing toward and spaced from the outer rod.

The rods 18 and 20 can be of any cross-sectional, keying type configuration such as square, round or oval, and of any material including aluminum which may be anodized, stainless steel, brass, or plastic such as polystyrene, cellulose acetate butyrate, polyester or epoxy fiberglass or the like. These rods may also be made in sections, one section slidable within the other in known manner for providing adjustment for accommodating substantially different width shower stalls.

The end plates 22 and 24 also may be of any convenient configuration, but preferably substantially as shown, and may be of solid or shell type construction of any of the above recited materials of construction. The keying sockets or apertures 30 provided in these plates have a non-circular cross-sectional configuration, such as square, rectangular, eliptical, or the like which prevent rotation of the end portions 32 of rod 20. These end portions may be integral with and formed on, or attached to shaft-like segments or projections 38 by any suitable means such as screws, welding, brazing, or the like, each said projection having a cross-sectional configuration which will allow it to slide through socket or aperture 30 and key therein to prevent rotational motion of rod 20. Projections 38 are of a suitable length for allowing slidable adjustability within the sockets, however, they are preferably sufficiently short to allow the functional or inner curtain 40 to be positioned close to the ends 14 and 16 of the shower stall. In preferred embodiments of the invention, end plates 22 and 24 are sufficiently thick to allow some linear adjustment, e.g., one or two inches, of projections 38 within sockets 30 to accommodate variances in shower stall widths and to assist in the rod unit installation.

The outer rod 18 mounted in first sockets or apertures 26 in the end plates is also preferably dimensioned to provide linear adjustment for accommodating shower stalls of varying widths. The end plates are attachable to walls 14 and 16 by any conventional means such as screws 44 or by water resistant adhesive of the type used, for example, to adhere soap dishes or the like to shower stall walls.

The functional inner and decorative outer curtains 40 and 46 respectively, may be of any design and color, are hung from their respective rods by any suitable hangers such as exemplified by 48, and including those hangers which completely encircle the rods and snap fasten at their ends as shown in U.S. Pat. No. 4,117,557. In this regard it is particularly noted that with the present construction wherein the inner rod is secured only at its end portions 32, no special provision needs to be made for allowing the hangers 48 to slide smoothly along the entire functional length of the rod, such as is required, for example, in the aforesaid U.S. Pat. No. 4,461,056.

The invention has been described in detail with particular reference to preferred embodiments thereof, but it will be understood that variations and modification will be effected within the spirit and scope of the invention.

I claim:

1. A dual curtain rod unit for installation between opposite walls of a shower stall, said unit comprising an outer rod, a substantially bow-shaped inner rod of uninterrupted, substantially smooth outer surface construction over its entire functional length, keying shaft means on each end portion of said inner rod, a pair of end plate means adapted for attachment to opposite walls of a shower stall, first socket means in a forward portion of each of said end plate means for receiving and supporting the ends of said outer rod, and keying socket means in a rearward portion of each of said end plate means for receiving and supporting the keying shaft means of said inner rod in a mating, sliding-fit, non-rotative manner with the bow of said inner rod facing toward said outer rod, said keying socket means being the only points of attachment of said inner rod, thus allowing for said uninterrupted surface thereof along its entire functional length for permitting slide hangers mounted thereon to slide without significant resistance.

2. The unit of claim 1 wherein said keying socket means and said keying shaft means have substantially rectangular or square cross-sectional configuration of close slide-fitting dimensions.

3. The unit of claim 2 wherein the depth of each said socket means is greater than about one inch to provide length adjustment for said rods during installation and for accommodating shower stalls of different dimensions.

4. The unit of claim 2 wherein each of said end plate means comprises an elongated member having said first and said keying socket means located substantially adjacent opposite ends thereof.

5. The unit of claim 4 wherein each of said end plate means comprise a formed metal, plastic or ceramic shell.

6. The unit of claim 4 wherein each of said end plate means comprise a substantially solid body of metal, plastic or ceramic.

7. The unit of claim 1 wherein said outer and inner rods are tubular and each comprises at least two segments wherein a portion of one segment is slidable within a portion of the other segment to provide substantial length adjustment to said rods.

* * * * *